US012291873B2

(12) United States Patent
Stearns et al.

(10) Patent No.: US 12,291,873 B2
(45) Date of Patent: May 6, 2025

(54) SNOWGUARD

(71) Applicant: Vermont Slate & Copper Services, Inc., Morristown, VT (US)

(72) Inventors: Brian Cecil Stearns, Tucson, AZ (US); Kris Michaud, Morristown, VT (US); Crystal Fletcher, Morristown, VT (US)

(73) Assignee: Vermont Slate & Copper Services, Inc., Morrisville, VT (US)

( * ) Notice: Subject to any disclaimer, the term of this patent is extended or adjusted under 35 U.S.C. 154(b) by 54 days.

(21) Appl. No.: 18/057,748

(22) Filed: Nov. 21, 2022

(65) Prior Publication Data

US 2023/0160209 A1 May 25, 2023

Related U.S. Application Data

(60) Provisional application No. 63/281,569, filed on Nov. 19, 2021.

(51) Int. Cl.
*E04D 13/10* (2006.01)

(52) U.S. Cl.
CPC ..... *E04D 13/10* (2013.01)

(58) Field of Classification Search
CPC ..... E04D 13/10
USPC ..... 52/24, 25, 26
See application file for complete search history.

(56) References Cited

U.S. PATENT DOCUMENTS 450,251 A * 4/1891 O'Gara ..... E04D 13/10 52/25
472,296 A * 4/1892 Houghton et al. ..... E04D 13/10 52/26
558,678 A * 4/1896 Esselen ..... E04D 13/10 52/26
591,594 A * 10/1897 Esselen ..... E04D 13/10 52/26
659,392 A * 10/1900 Gilman ..... E04D 13/10 52/24
676,579 A * 6/1901 Esselen ..... E04D 13/10 52/26

(Continued)

FOREIGN PATENT DOCUMENTS

CH 634120 A5 * 1/1983
DE 202013103107 U1 * 11/2014 ..... E04D 13/10

OTHER PUBLICATIONS

Machine Translation of CH 634 120 A5; https://worldwide.espacenet.com/patent/search/family/004223859/publication/CH634120A5?q=CH%20634120 (Year: 2024).*

*Primary Examiner* — Ryan D Kwiecinski
(74) *Attorney, Agent, or Firm* — KW Law, LLP

(57) ABSTRACT

A snowguard comprises a shaft, an attachment point, a support member, and a snow catcher. The shaft has a first end and a second end. The shaft has a first body disposed between the first end and the second end. The attachment point is disposed at the first end of the shaft. The support member has a third end and a fourth end. The support member has a second body defined between the third end and the fourth end. The third end of the support member is operatively coupled to the second end of the shaft. The support member extends away from the shaft at a first angle. The snow catcher is operatively coupled to the fourth end of the support member and the first body at a point between the first end and the second end.

16 Claims, 12 Drawing Sheets

(56) References Cited

U.S. PATENT DOCUMENTS

| | | | | | |
|---|---|---|---|---|---|
| 752,216 | A * | 2/1904 | Folsom | E04D 13/10 | 52/26 |
| 1,508,844 | A * | 9/1924 | Geiser | E04D 13/10 | 52/24 |
| 1,626,995 | A * | 5/1927 | Willms | E04D 13/10 | 52/26 |
| 2009/0241436 | A1 * | 10/2009 | Jacobs | E04D 13/10 | 52/24 |
| 2014/0305046 | A1 * | 10/2014 | Stearns | E04D 3/38 | 52/704 |
| 2023/0349159 | A1 * | 11/2023 | Stearns | E04D 13/10 | |

* cited by examiner

SNOWGUARD

CROSS REFERENCE TO RELATED APPLICATIONS

The present application claims priority to and the benefit of U.S. Provisional Patent Application No. 63/281,569, filed Nov. 19, 2021 and entitled Snow Catcher Snowguard, the entire contents of which is herein incorporated by reference for any purpose.

FIELD

The present disclosure relates to ice and/or snow retention system. More particularly, the present disclosure relates to ice and/or snow retention systems for sloped roofs.

BACKGROUND

Snow management of the roofs of buildings and homes allows snow to melt and run off a roof as water. Moreover, there is a need for snow management systems that are suitably strong, early to install, capable of being installed in a watertight fashion, and visually appealing.

SUMMARY

In various embodiments, a snowguard comprises a shaft, an attachment point, a support member, and a snow catcher. The shaft has a first end and a second end. The shaft has a first body disposed between the first end and the second end. The attachment point is disposed at the first end of the shaft. The attachment point defines a first aperture. The attachment point can be a ring or loop. The support member has a third end and a fourth end. The support member has a second body defined between the third end and the fourth end. The third end of the support member is operatively coupled to the second end of the shaft. The support member extends away from the shaft at a first angle. The snow catcher is operatively coupled to the fourth end of the support member and the first body at a point between the first end and the second end.

In various embodiments, a snow management system that is installed on a roof having roof shingles comprises a snow guard, a seal, a fastener, and a flashing. The snowguard comprises a shaft, an attachment point, a support member, and a snow catcher. The shaft has a first end and a second end. The shaft has a first body disposed between the first end and the second end. The attachment point is formed at the first end of the shaft. The attachment point defines a first aperture. The support member is formed at the second end of the shaft. The support member extends away from the shaft at a first angle. The support member has a third end and a fourth end. The support member has a second body defined between the third end and the fourth end. The snow catcher is operatively formed at the fourth end of the support member. The snow catcher comprises an outer surface. The outer surface of the snow catcher is bonded to the first body at a point between the first end and the second end. The seal has a shaft portion and a base portion. The shaft portion is installable through the first aperture of the attachment point. The fastener is installable through the shaft portion. The attachment point and configured to attach the snowguard to the roof. The flashing is installed between the fastener and the attachment point.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

In various embodiments, the snow management systems disclosed herein may be configured to retain, manage, and/or otherwise hold snow and ice in place. More specifically, the systems may be configured to retain snow and ice from sliding, falling or blowing off the roof, facade or ledges of buildings and residential homes. The systems may be configured to manage snow and ice on buildings to encourage melting and/or "slow" disposition of snow and ice in small or liquid pieces.

Figure 1A:
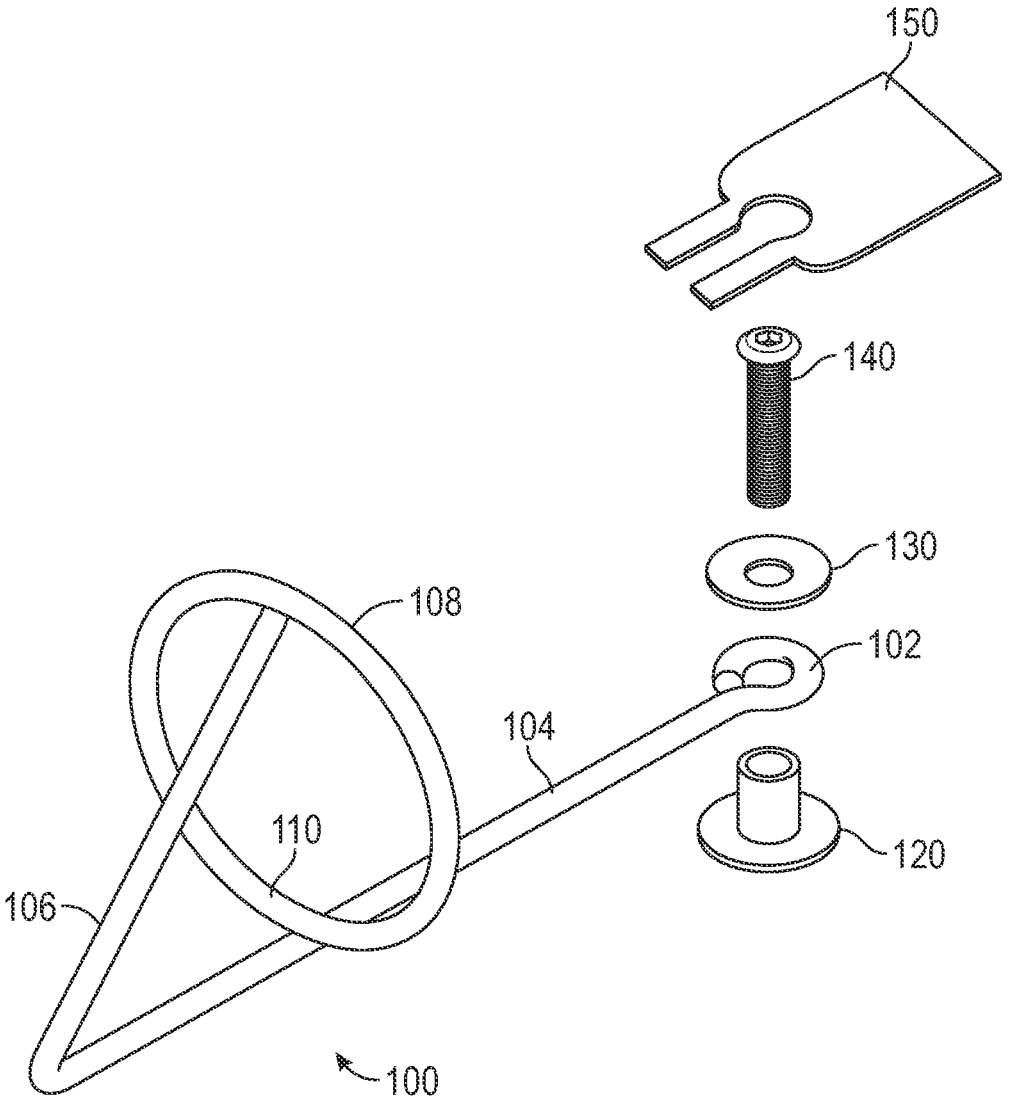
FIG. 1A illustrates an exploded perspective view of a snow management system with a first flashing system, in accordance with various embodiments.
Figure 1B:
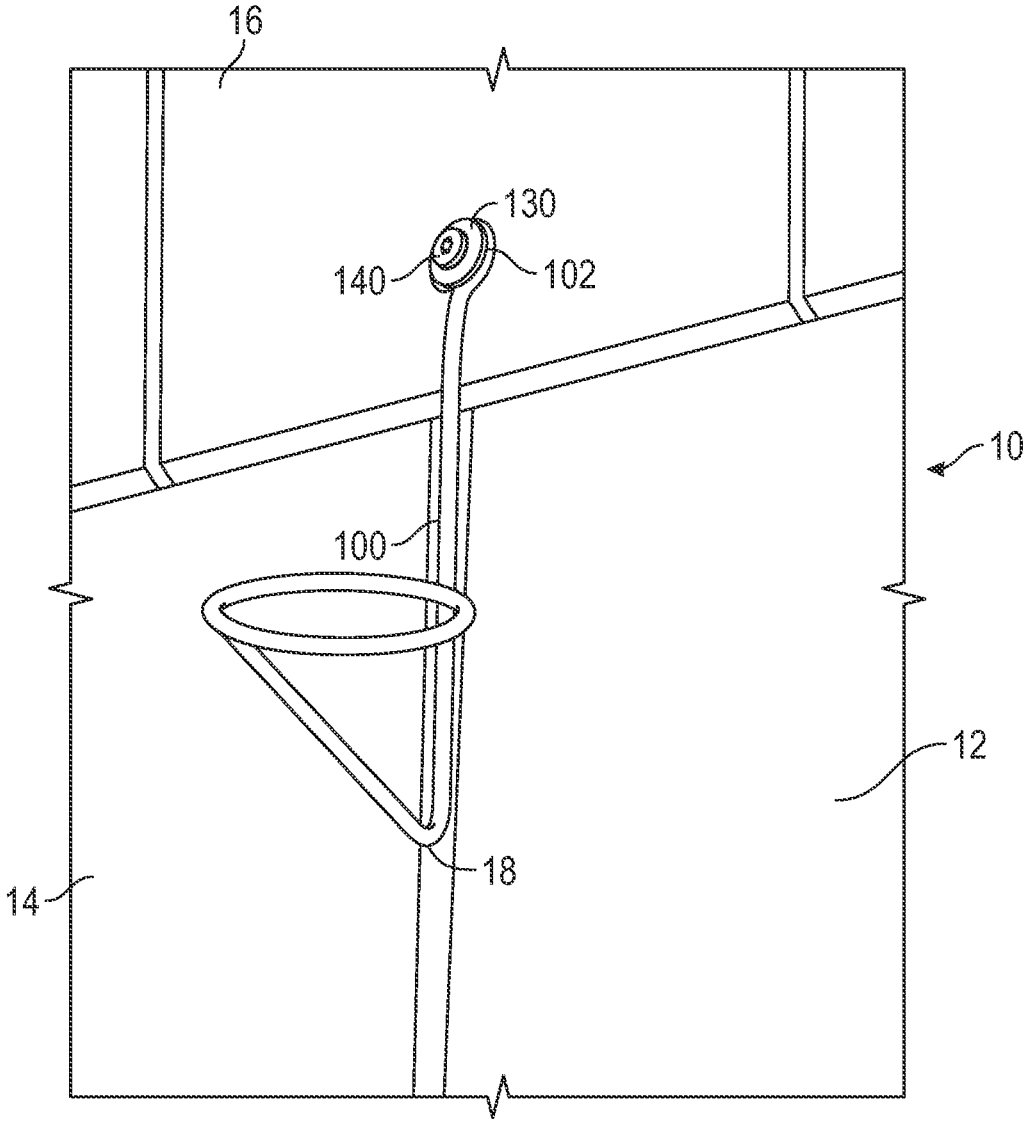
FIG. 1B illustrates a perspective view of a snow management system installed on a roof surface, in accordance with various embodiments.
Figure 1C:
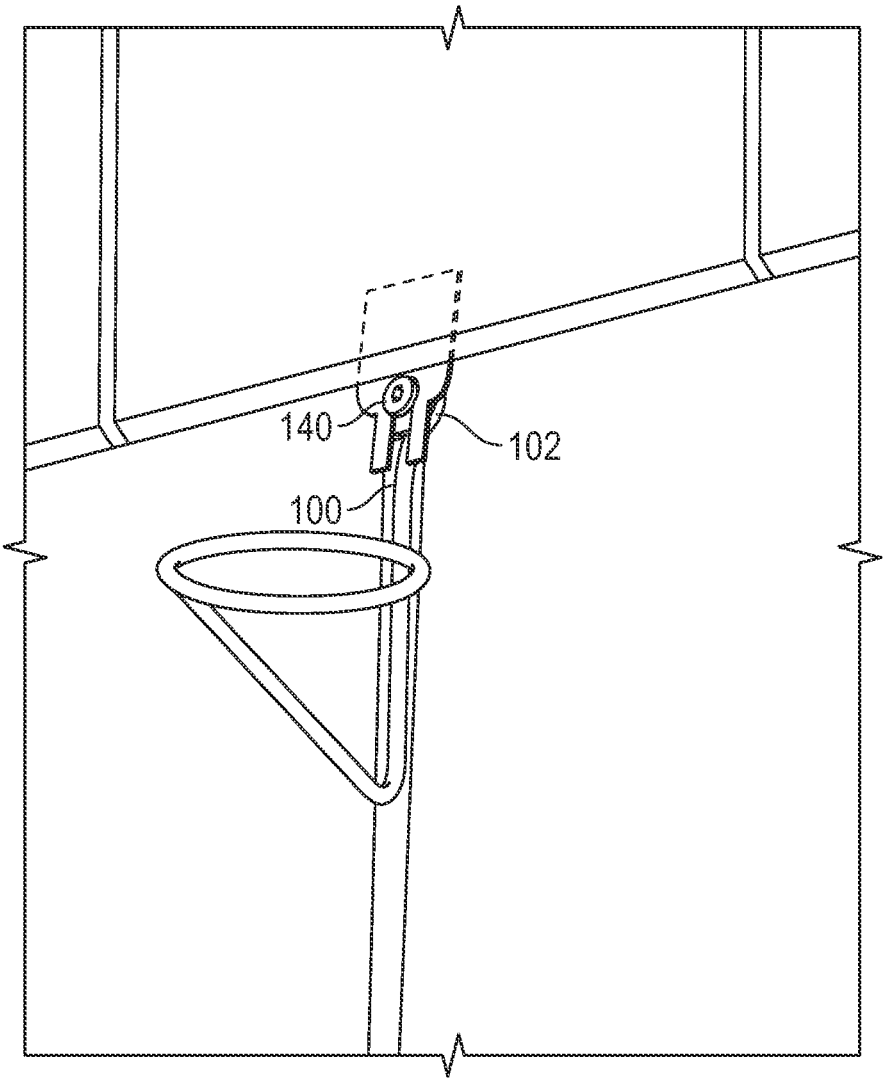
FIG. 1C illustrates a perspective view of a snow management system installed on a roof surface with the first flashing system, in accordance with various embodiments.

In various embodiments and with reference to FIGS. 1A-1C, snow management system may comprise a snow retention bracket 100 comprising a shaft 104, an attachment point 102, a support member 106, and a snow catcher 108. Shaft 104 may be an elongate member. Shaft 104 may have a first end and a second end. Shaft 104 may comprise a shaft body defined between the first end and the second end. Attachment point 102 may be disposed at the first end of shaft 104. Attachment point 102 may be operatively coupled to the first end or may be integrally formed with the first end. Attachment point 102 may define a hole or aperture. Support member 106 may be an elongate member. Support member 106 may have a third end and a fourth end. Support member 106 may comprise a support member body defined between the third end and the fourth end. Support member 106 may be operatively coupled to shaft 104. In this regard, the third end of Support member 106 may be operatively coupled to or integrally formed with the second end of shaft 104. Snow catcher 108 may be operatively coupled to or integrally formed with the fourth end of support member 106. Snow catcher 108 is also coupled to the body of shaft 104 at a point between the first end and the second end. In this regard, snow catcher 108 may be rigidly coupled or bonded to the body of shaft 104.

Support member 106 may be disposed at an angle relative to shaft 104. In this regard, Support member 106 may extend away from shaft 104 at an angle. The angle may be between 15 degrees and 75 degrees. In one embodiment, the angle is 45 degrees.

In various embodiments, snow catcher 108 may be made to be a closed structure. In this regard the loop or other shape formed by snow catcher 108 may be shaped or formed from a rod or similar material and then bonded, brazed, welded, glued or otherwise attached to itself. Snow catcher 108 may also be welded, brazed, bonded, glued or other attached to the body of shaft 104 as discussed herein. The closing of snow catcher 108 and the attachment of snow catcher 108 to the body of shaft 104 increase the rigidity of snow retention bracket 100. These attachments also dramatically increase the snow load capabilities of snow retention bracket 100.

In various embodiments, snow retention bracket 100 may be made of steel, stainless steel, copper, brass, aluminum, a composite metal, a plastic material, a fiber reinforced plastic material, a polymer material and/or the like.

In various embodiments, snow retention bracket 100 may be homogenous. Snow retention bracket may be a continuous structure. In this regard, snow retention bracket 100 may be formed from single piece of material. In other embodiments, snow retention bracket, may be an assembly.

When installed on a roof, the body of shaft 104 may rest in or be capture in the keyway 18 of one or more roof shingle 12, roof shingle 14, roof shingle 16, and/or the like. While in keyway 18, the angular movement of snow management bracket 100 may be reduced or eliminated. In this regard, snow management bracket 100 may have reduced friction with the roof surface. Snow management bracket 100 may also be retained in a position normal to the lateral snow load on the roof. The roof shingles may be any suitable shingle, or tile, such as, for example, asphalt shingles, slate shingles, synthetic slate shingles, solar shingles, concrete tiles and/or the like.

In various embodiments, the snow management system may comprise an assembly for securing snow retention bracket 100 a roof surface. Generally, to secure a structure to a roof, a user must penetrate the roofs otherwise watertight surface. The securing assembly provides for a watertight penetration. The securing assembly may comprise a seal 120, a washer 130, a fastener 140, and/or a flashing or cover 150. Seal 120 may be any suitable structure as defined more specifically herein. Seal 120 may be disposed beneath and/or through the aperture defined by attachment point 102. Washer 130 may be disposed or installed on attachment point 102 and/or seal 120. Flashing 150 may be installed on washer 130. Flashing 150 may comprise a pair of flashing tabs defined on a downslope side of flashing 150. Moreover, the flashing tabs may define a fastener channel that is adjacent and connected to a fastener aperture. Fastener 140 may be installed through flashing 150, washer 130, attachment point 102, and seal 120 to engage a roof surface. In this regard, fastener 150 is configured to attach snow management bracket 100 to a roof or building surface.

Figure 2:
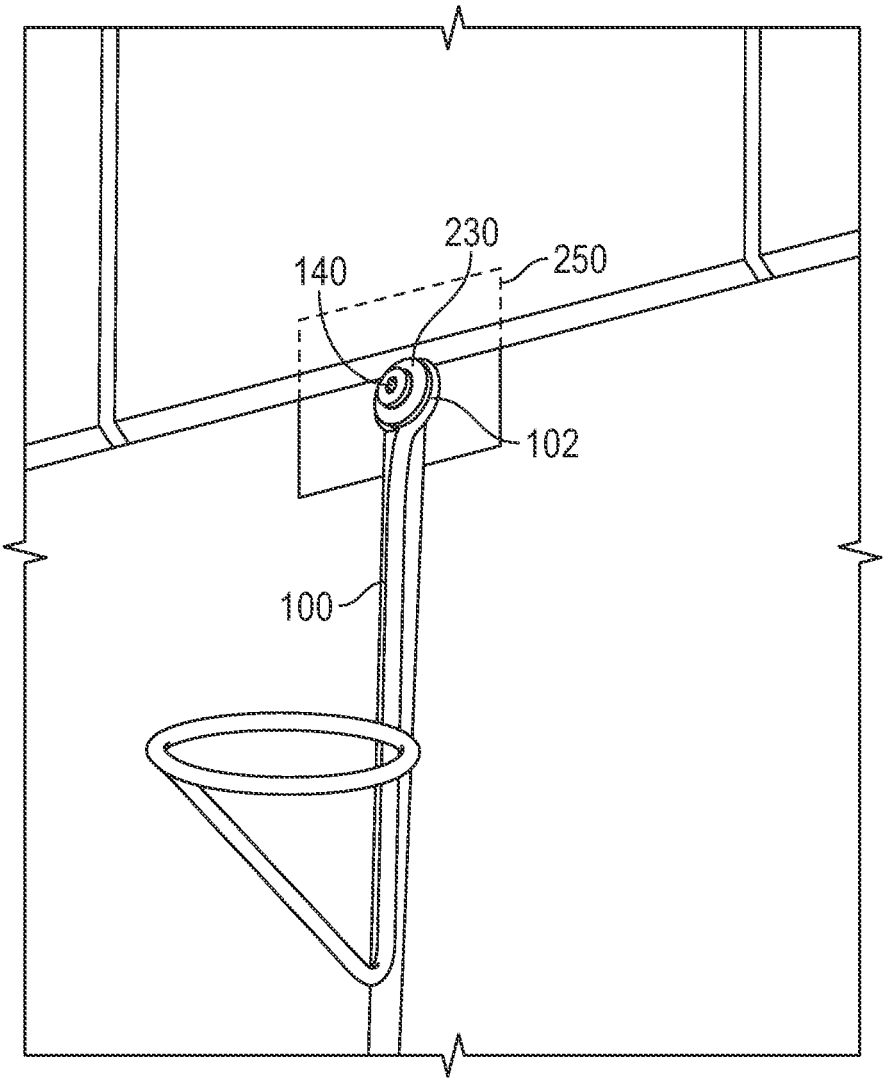
FIG. 2 illustrates a perspective view of a snow management system installed on a roof surface with a second flashing system, in accordance with various embodiments.

In various embodiments and with reference to FIG. 2, flashing 250 may be configured protrude from one or more upper courses of roofing and cover the attachment assembly hardware, including attachment point 102. In this regard, attachment point 102 and the associated attachment assembly hardware, seal, and roof penetration would be beneath and covered by flashing 250.

Figure 3A:
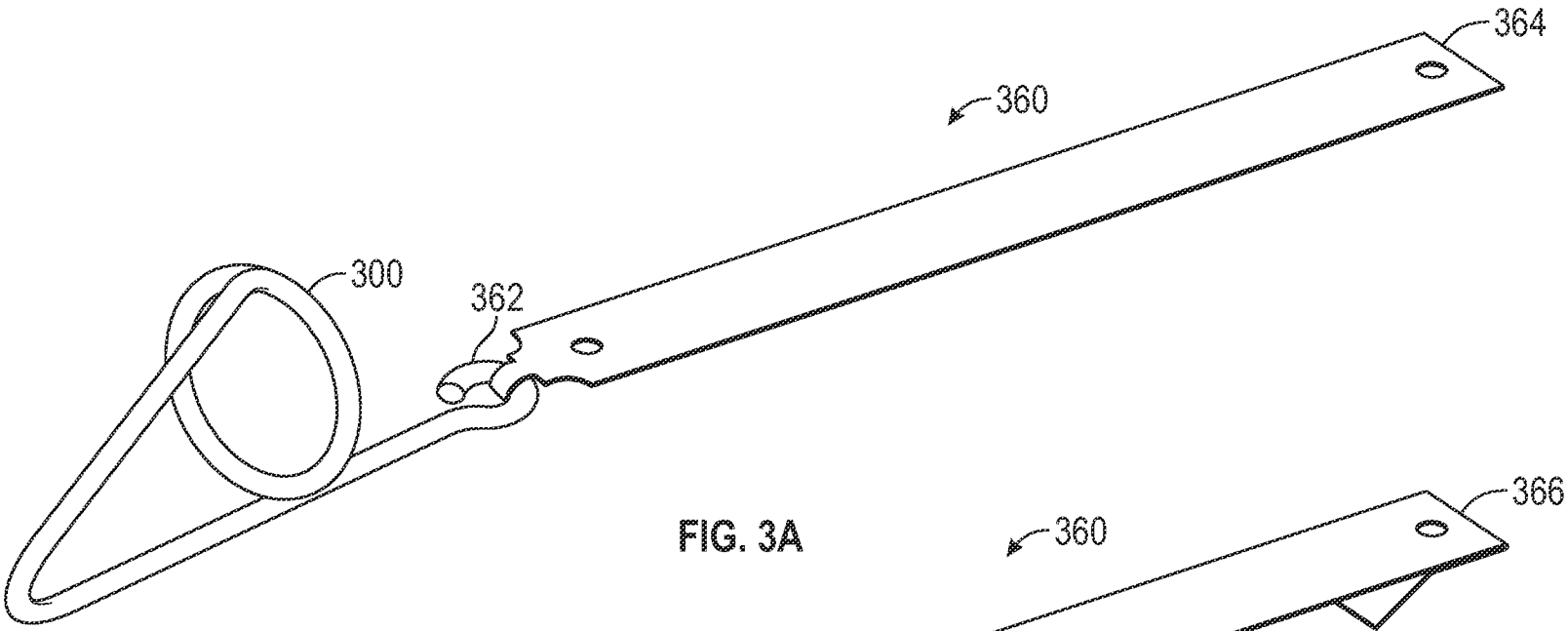
FIGS. 3A-FIG. 3C illustrate perspective views of a snow management system with various exemplary attachment straps, in accordance with various embodiments.
Figure 3B:
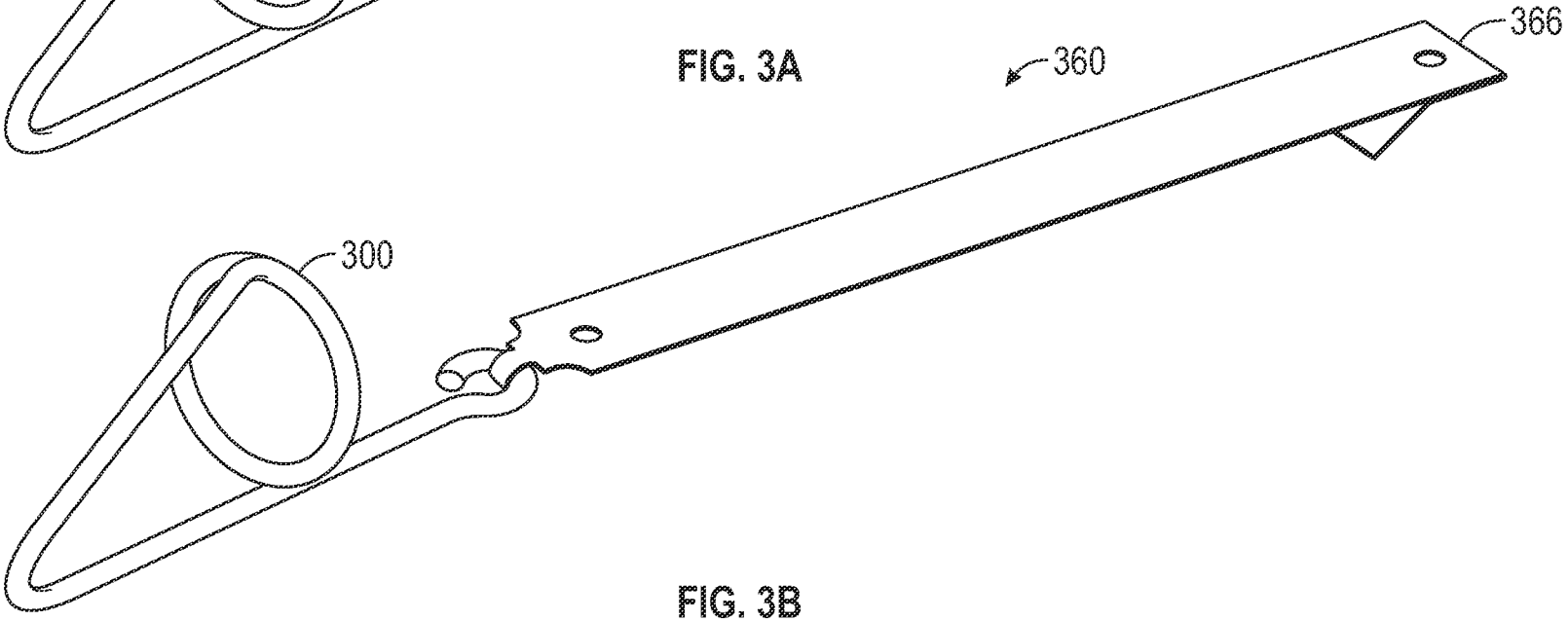
Figure 3C:
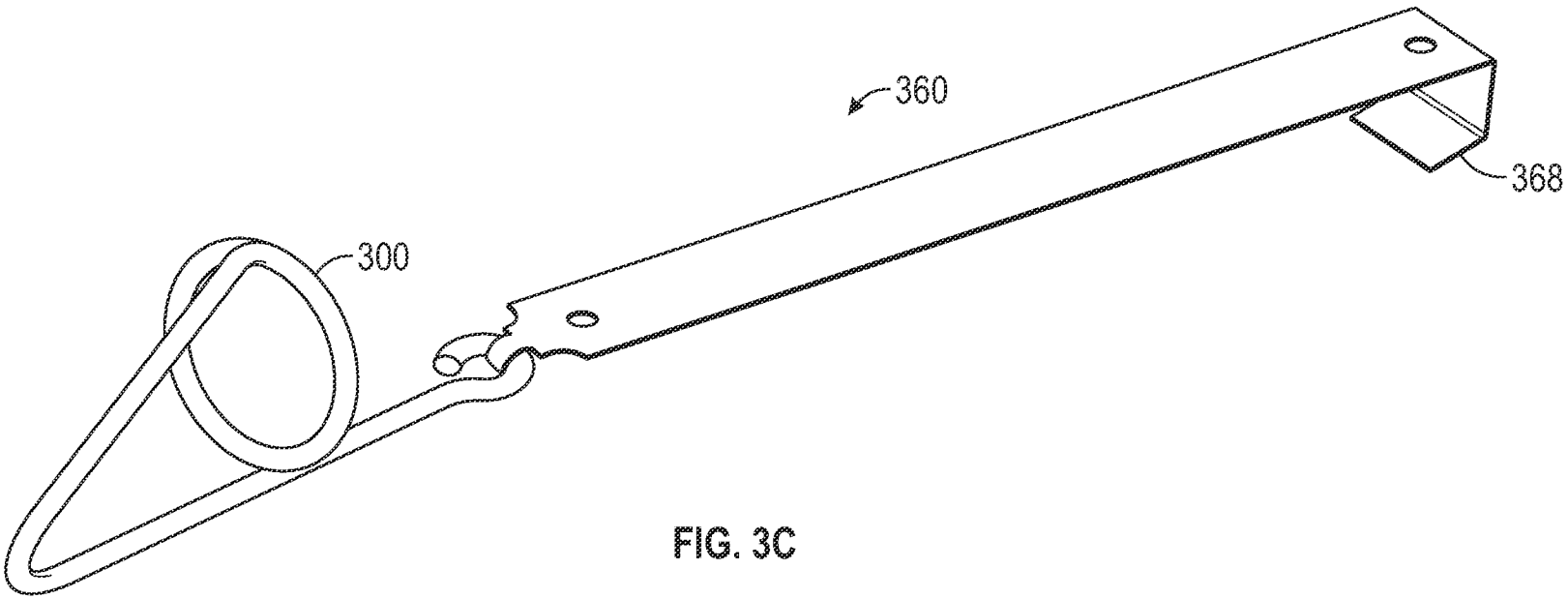

In various embodiments and with reference to FIGS. 3A-3C, snow management bracket 300 may be attached to a roof surface or roofing material (i.e., a shingle or tile) with a strap 360. Strap 360 may have a downslope end and an upslope end. The down slope end may define an attachment structure 362 that is configured to receive and retain a portion of snow management bracket 300. The upslope end of strap 360 may define an attachment mechanism, such as, for example, a fastener or nail hole 364, an attachment tab and/or hole system 366, and or a tile hook 368.

Figure 4:
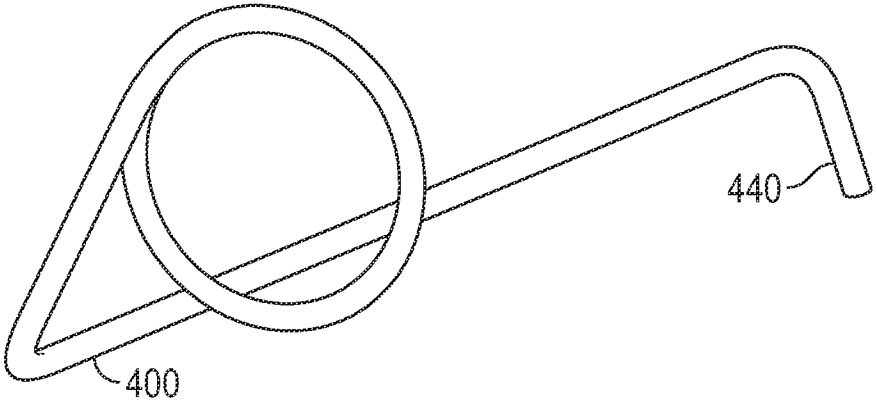
FIG. 4 illustrates a perspective view of a snow management system including a nail shaft attachment, in accordance with various embodiments.
Figure 5A:
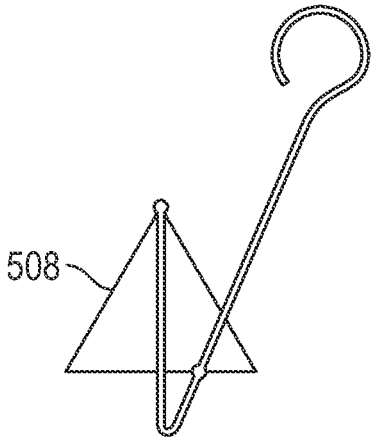
FIGS. 5A-FIG. 5D illustrate perspective views of a snow management system with various snow retention shapes, in accordance with various embodiments.
Figure 5B:
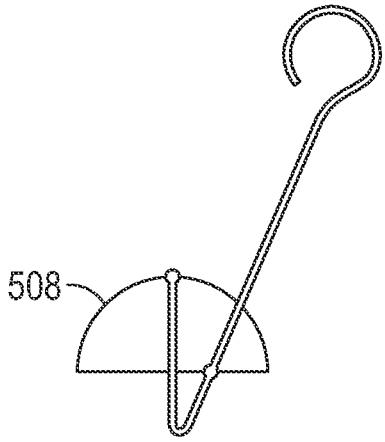
Figure 5C:
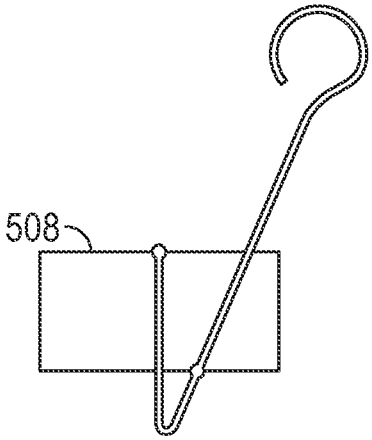
Figure 5D:
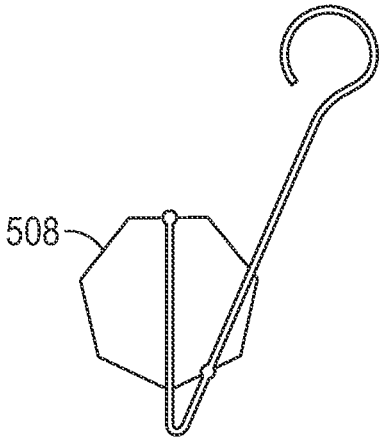

In various embodiments and with reference to FIG. 4, snow management bracket 400 may comprise in integral fastener or nail shaft 440 in lieu of the attachment point described herein.

In various embodiments and with reference to FIGS. 5A-5D, snow catcher 508 may be any suitable shape, including for example, a triangular shape, a circular or half circle shape, a square or rectangular shape, a hexagonal shape, an octagonal shape, a uniform shape, a non-uniform shape, and/or the like.

Figure 6:
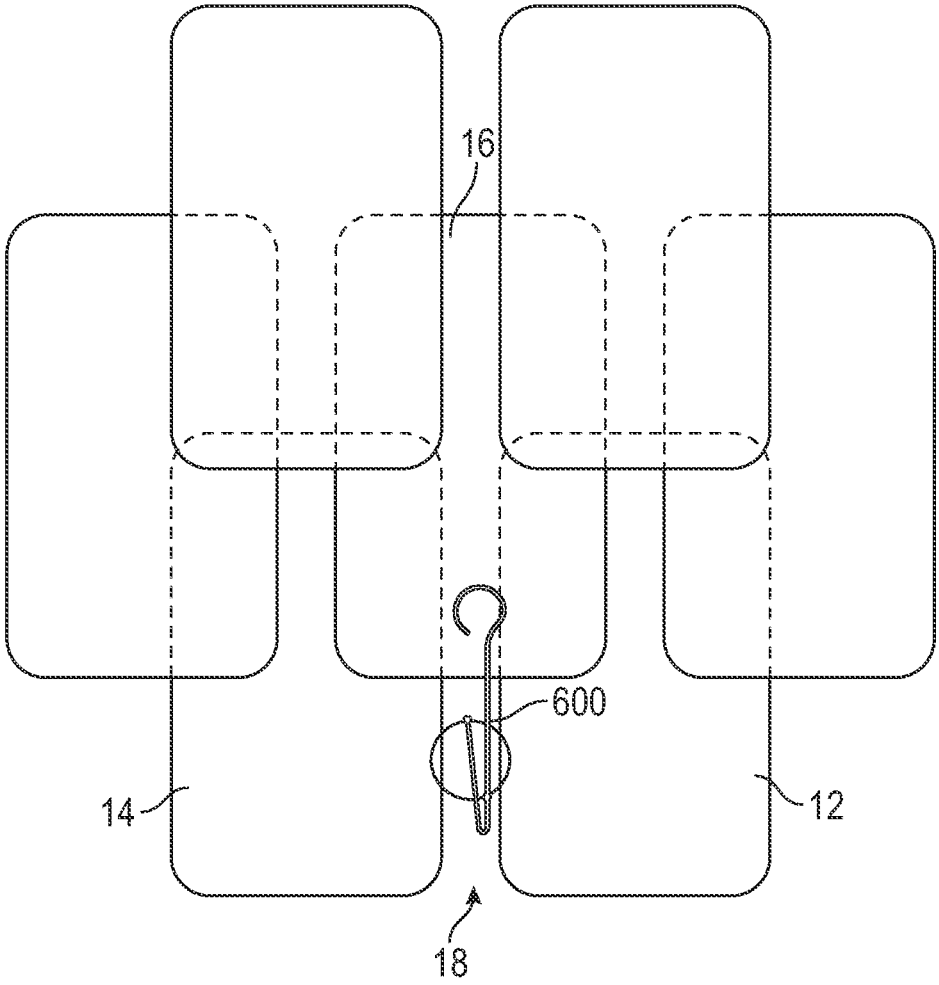
FIG. 6 illustrates a top view of a snow management system installed on a roof surface, in accordance with various embodiments.

In various embodiments and with reference to FIG. 6, the shaft of snow management bracket 600 may be disposed below the snow catcher in in keyway 18 between roof shingles 12 and 14. Similarly, the snow catcher may be adjacent to the shaft of snow management bracket 600. The shaft of snow management bracket 600 may be captured in keyway 18 to limited radial movement, reduce friction and engage lateral snow loads.

Figure 7:
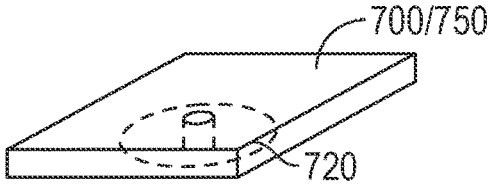
FIG. 7 illustrates a top perspective view of flashing/bracket with a seal, in accordance with various embodiments.
Figure 8A:
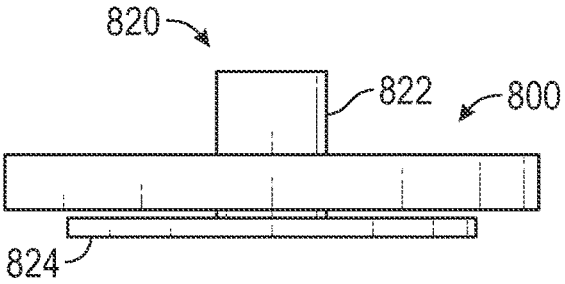
FIGS. 8A and 8D illustrate a front view and a cross-sectional view of a first seal, in accordance with various embodiments.
Figure 8B:
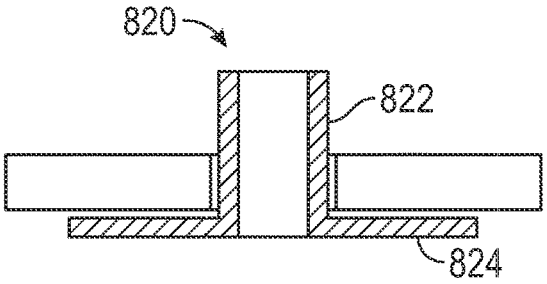
Figure 8C:
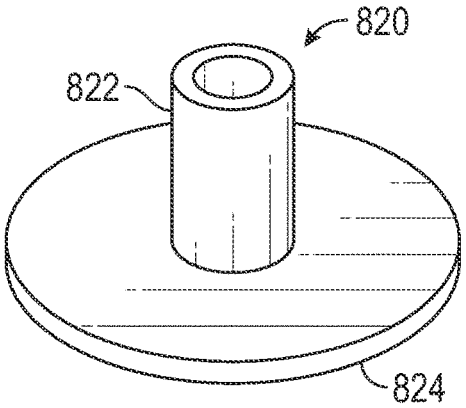
Figure 8D:
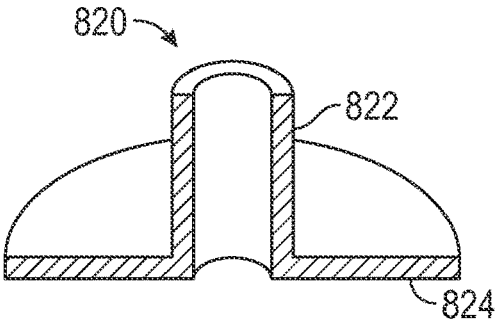

With reference to FIG. 7, a bracket 700 or a flashing 750 may be configured to engage, load, and otherwise cover a seal 720. Seal 720 may comprise a through hole. The through hole may be sized to receive a fastener, which may compress seal 720 against a mounting surface and the body of the fastener. In this regard, seal 720 may be configured to create a watertight attachment point with the fastener.

In various embodiments and with reference to FIGS. 8A-8D, seal 820 may comprise a shaft 822 and a seal body 824. Shaft 822 may be integrally formed with seal body 824. Shaft 822 may also be assembled through or on seal body 824. Moreover, shaft 822 may be substantially perpendicular to seal body 824. Shaft 822 may define a channel that is sized to receive a fastener or other structure. Shaft 822 may be sized to compress or load the shaft of a fastener or other suitable structure. Seal 820 may be made of an elastically resilient material that is deformable under load, such as a rubber material, like ethylene propylene diene monomer rubber.

Figure 9A:
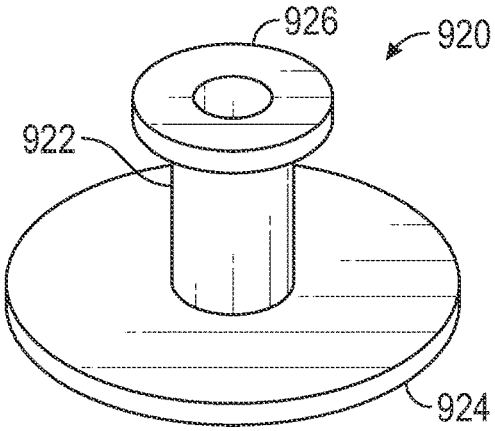
FIGS. 9A and 9B illustrate a front perspective view and a cross-sectional view of a second seal, in accordance with various embodiments.
Figure 9B:
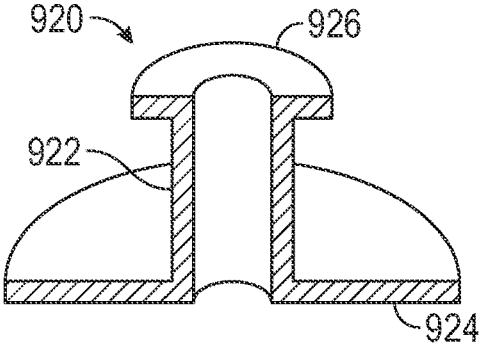

In various embodiments and with reference to FIGS. 9A and 9B, seal 920 may comprise a shaft 922, a seal body 924, and a seal top disc 926. Shaft 922 may be integrally formed with seal body 924 and seal top disc 926. Shaft 922 may also be assembled through or on seal body 924. Similarly, seal top disc 926 may be installed on an end of shaft 922 opposite seal body 924. Moreover, shaft 922 may be substantially perpendicular to seal body 924 and/or seal top disc 926. Seal body 924 and seal top disc 926 may be substantially parallel to one another. Shaft 922 may define a channel that is sized to receive a fastener or other structure. Shaft 922 may be sized to compress or load the shaft of a fastener or other suitable structure such as a bracket. Seal top disc 926 may similarly be configured to load a fastener head a bracket portion. Seal 920 may be made of an elastically resilient material that is deformable under load, such as a rubber material, like ethylene propylene diene monomer rubber.

Figure 10A:
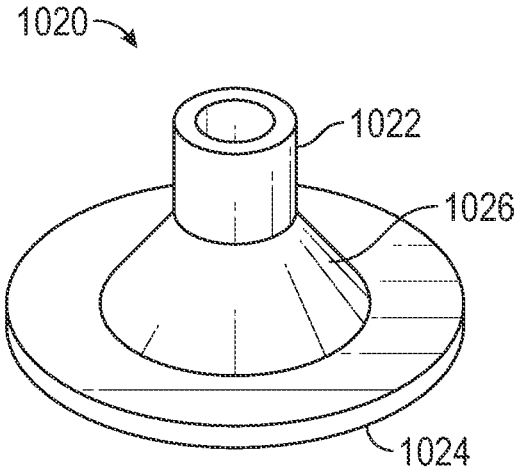
FIGS. 10A and 10B illustrate a front perspective view and a cross-sectional view of a third seal, in accordance with various embodiments.
Figure 10B:
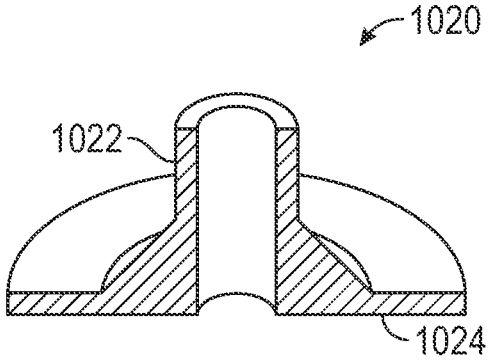

In various embodiments and with reference to FIGS. 10A-10B, seal 1020 may comprise a shaft 1022 and a seal body 1024. Shaft 1022 may be integrally formed with seal body 1024. Shaft 1022 may also be assembled through or on seal body 1024. Moreover, shaft 1022 may be substantially perpendicular to seal body 1024. Shaft 1022 and/or seal body 1024 may include an angled portion 1026, which can have a frustoconical shape, defined along a length of shaft 1022. In this regard, a portion of shaft 1022 may protrude beyond angled portion 1026. Shaft 1022 may define a channel that is sized to receive a fastener or other structure. Shaft 1022 may be sized to compress or load the shaft of a fastener or other suitable structure. Seal 1020 may be made of an elastically resilient material that is deformable under load, such as a rubber material, like ethylene propylene diene monomer rubber.

Figure 11A:
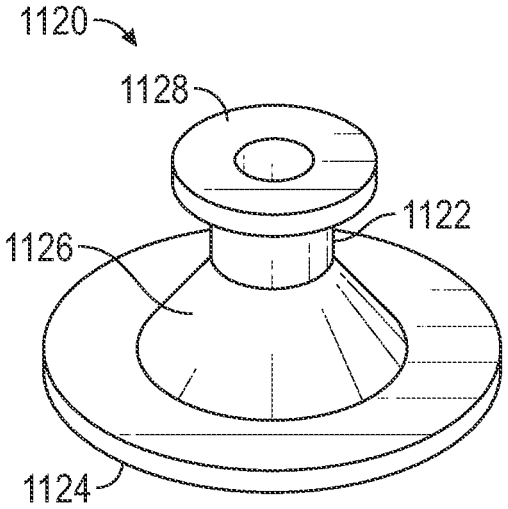
FIGS. 11A and 11B illustrate a front perspective view and a cross-sectional view of a fourth seal, in accordance with various embodiments.
Figure 11B:
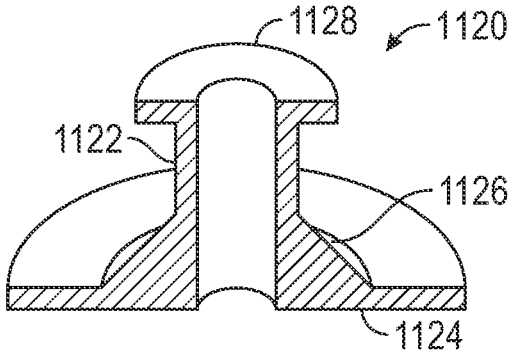

In various embodiments and with reference to FIGS. 11A-11B, see 1120 may comprise a shaft 1122, a seal body 1124, and a seal top disc 1128. Shaft 1122 may be integrally formed with seal body 1124. Shaft 1122 may also be assembled through or on seal body 1124. Similarly, seal top disc 1128 may be installed on an end of shaft 1122 opposite seal body 1124. Moreover, shaft 1122 may be substantially perpendicular to seal body 1124 and/or seal top disc 1128. Seal body 1124 and seal top disc 1128 may be substantially parallel to one another. Shaft 1122 and/or seal body 1124 may include an angled portion 1126, which can have a frustoconical shape, defined along a length of shaft 1122. In this regard, a portion of shaft 1122 may protrude beyond angled portion 1126. Shaft 1122 may define a channel that is sized to receive a fastener or other structure. Shaft 1122 may be sized to compress or load the shaft of a fastener or other suitable structure. Seal top disc 1128 may similarly be configured to load a fastener head a bracket portion. Seal 1120 may be made of an elastically resilient material that is deformable under load, such as a rubber material, like ethylene propylene diene monomer rubber.

Figure 12A:
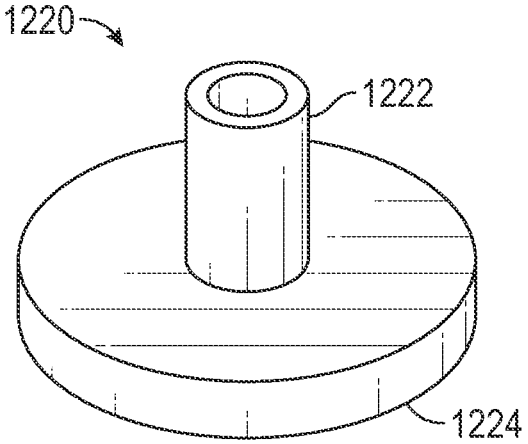
FIGS. 12A, 12B and 12C illustrate a front perspective view, a cross-sectional view, and a bottom view of a fifth seal, in accordance with various embodiments.
Figure 12B:
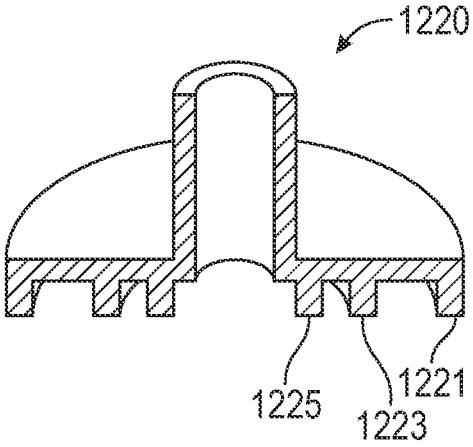
Figure 12C:
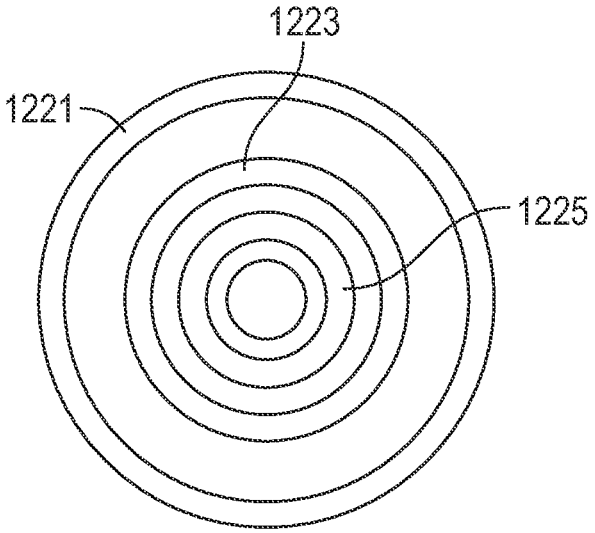

In various embodiments and with reference to FIGS. 12A-12C, seal 1220 may comprise a shaft 1222 and a seal body 1224. Shaft 1222 may be integrally formed with seal body 1224. Shaft 1222 may also be assembled through or on seal body 1224. Moreover, shaft 1222 may be substantially perpendicular to seal body 1224. Shaft 1222 may define a channel that is sized to receive a fastener or other structure. Shaft 1222 may be sized to compress or load the shaft of a fastener or other suitable structure. Seal body 1224 may comprise a one or more concentric seal fingers. For example, seal body 1224 may comprise a seal finger 1221, a seal finger 1223, and/or a seal finger 1225. Each seal finger may be the same shape as seal body 1224. Each seal finger may be concentric with shaft 1222 and/or the channel defined by shaft 1222. One or more seal fingers may define a channel disposed between the fingers. For example, seal finger 1223 may be disposed interior to seal finger 1221, defining a channel between the respective seal fingers. When compressed with a fastener or other structure seal finger 1221, seal finger 1223, and/or seal finger 1225 may create a plurality of sealing diameters. The sealing diameters may create a sealing gradient. In this regard, seal finger 1221, seal finger 1223, and/or seal finger 1225 may create increasing sealing pressure and seal engagement along an axis normal to shaft 1222 and may increase from the outer diameter of seal body 1224 to the center of sealing body 1224. Seal 1220 may be made of an elastically resilient material that is deformable under load, such as a rubber material, like ethylene propylene diene monomer rubber.

Figure 13A:
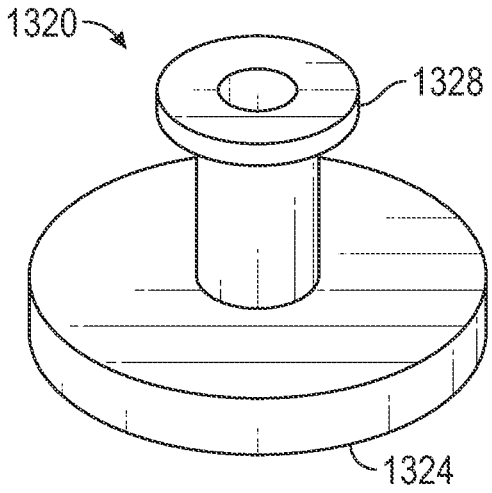
FIGS. 13A and 13B illustrate a front perspective view and a cross-sectional view of a sixth seal, in accordance with various embodiments.
Figure 13B:
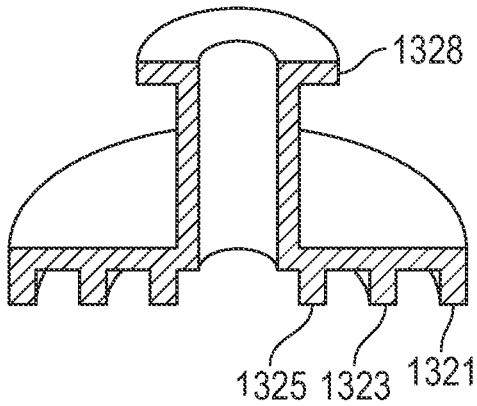

In various embodiments and with reference to FIGS. 13A-13C, seal 1320 may comprise a shaft 1322, a seal body 1324 and a sealing top disc 1328. Shaft 1322 may be integrally formed with seal body 1324 and sealing top disc 1328 as discussed herein. Shaft 1322 may also be assembled through or on seal body 1324. Moreover, shaft 1322 may be substantially perpendicular to seal body 1324. Seal body 1324 and seal top disc 1328 may be substantially parallel to one another. Shaft 1322 may define a channel that is sized to receive a fastener or other structure. Shaft 1322 may be sized to compress or load the shaft of a fastener or other suitable structure. Seal body 1324 may comprise a one or more concentric seal fingers. For example, seal body 1324 may comprise a seal finger 1321, a seal finger 1323, and/or a seal finger 1325. Each seal finger may be the same shape as seal body 1324. Each seal finger may be concentric with shaft 1322 and/or the channel defined by shaft 1322. One or more seal fingers may define a channel disposed between the fingers. For example, seal finger 1323 may be disposed interior to seal finger 1321, defining a channel between the respective seal fingers. When compressed with a fastener or other structure seal finger 1321, seal finger 1323, and/or seal finger 1325 may create a plurality of sealing diameters. The sealing diameters may create a sealing gradient. In this regard, seal finger 1321, seal finger 1323, and/or seal finger 1325 may create increasing sealing pressure and seal engagement along an axis normal to shaft 1322 and may increase from the outer diameter of seal body 1324 to the center of sealing body 1324. Seal 1320 may be made of an elastically resilient material that is deformable under load, such as a rubber material, like ethylene propylene diene monomer rubber.

Figure 14A:
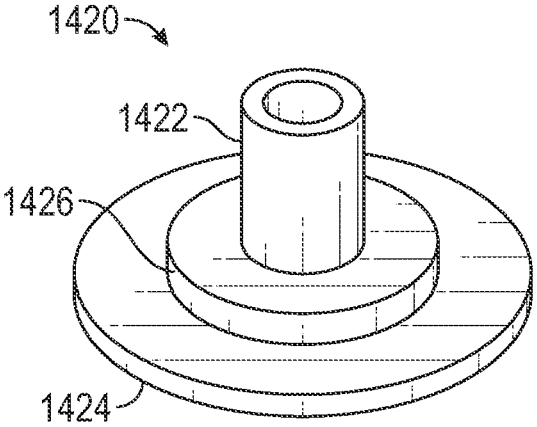
FIGS. 14A and 14B illustrate a front perspective view and a cross-sectional view of a seventh seal, in accordance with various embodiments.
Figure 14B:
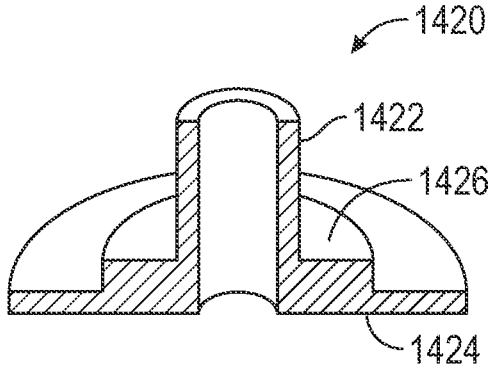

In various embodiments and with reference to FIGS. 14A and 14B, seal 1420 may comprise a shaft 1422 and a seal body 1424. Shaft 1422 may be integrally formed with seal body 1424. Shaft 1422 may also be assembled through or on seal body 1424. Moreover, shaft 1422 may be substantially perpendicular to seal body 1424. Shaft 1422 and/or seal body 1424 may include a stepped portion 1426, defined along a length of shaft 1422. In this regard, a portion of shaft 1422 may protrude beyond stepped portion 1426. Stepped portion 1426 may have a diameter that is less than the outer diameter of seal body 1424. Shaft 1422 may define a channel that is sized to receive a fastener or other structure. Shaft 1422 may be sized to compress or load the shaft of a fastener or other suitable structure. Seal 1420 may be made of an elastically resilient material that is deformable under load, such as a rubber material, like ethylene propylene diene monomer rubber.

Figure 15A:
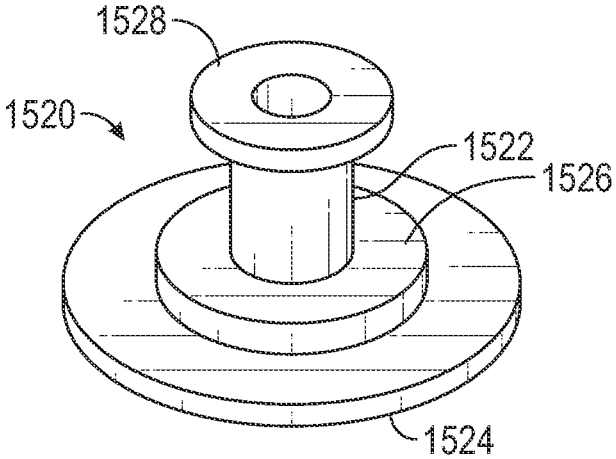
FIGS. 15A and 15B illustrate a front perspective view and a cross-sectional view of an eighth seal, in accordance with various embodiments.
Figure 15B:
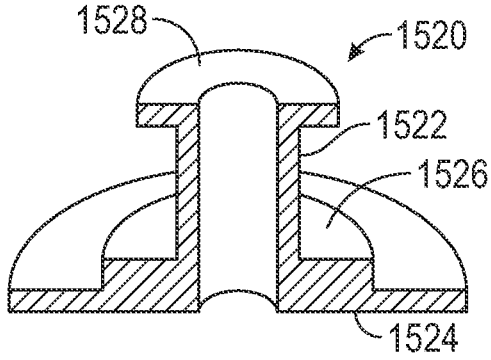

In various embodiments and with reference to FIGS. 15A and 15B, seal 1520 may comprise a shaft 1522, a seal body 1524, and a seal top disc 1528 as discussed herein. Shaft 1522 may be integrally formed with seal body 1524. Shaft 1522 may also be assembled through or on seal body 1524. Moreover, shaft 1522 may be substantially perpendicular to seal body 1524 seal top disc 1528. Shaft 1522 and/or seal body 1524 may include a stepped portion 1526, defined along a length of shaft 1522. In this regard, a portion of shaft 1522 may protrude beyond stepped portion 1526. Stepped portion 1526 may have a diameter that is less than the outer diameter of seal body 1524. Stepped portion 1526 may have a diameter that is greater than the outer diameter of seal top disc 1528. Shaft 1522 may define a channel that is sized to receive a fastener or other structure. Shaft 1522 may be sized to compress or load the shaft of a fastener or other suitable structure. Seal 1520 may be made of an elastically resilient material that is deformable under load, such as a rubber material, like ethylene propylene diene monomer rubber.

After reading the present disclosure, one of ordinary skill will appreciate that the various seal features described herein may be combined in various way without departing from the scope of the present disclosure.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A snowguard, comprising:

a shaft having a first end and a second end, the shaft having a first body disposed between the first end and the second end, the shaft shaped and sized to be installed in a keyway defined between a pair of roofing shingles, wherein the shaft is retained in the keyway between the pair of roofing shingles;

an attachment point disposed at the first end of the shaft, the attachment point defining a first aperture;

a fastener installable through the attachment point;

a flashing defining a pair of flashing tabs on a downslope side of the flashing, the flashing tabs defining a fastener channel, the flashing installable between the fastener and the attachment point, the fastener configured to compress the flashing against the attachment point;

a support member having a third end and a fourth end, the support member having a second body defined between the third end and the fourth end, the third end of the support member operatively coupled to the second end of the shaft, and extending away from the shaft at a first angle; and a snow catcher operatively coupled to the fourth end of the support member and the first body at a point between the first end and the second end.

2. The snowguard of claim 1, wherein the attachment point defines a ring.

3. The snowguard of claim 1, wherein the angle is between 15 degrees and 75 degrees.

4. The snowguard of claim 1, wherein the angle is 45 degrees.

5. The snowguard of claim 1, wherein the attachment point, the shaft, the support member, and the snow catcher are formed from a single piece of metal.

6. The snowguard of claim 1, wherein the snow catcher is a continuous structure.

7. The snowguard of claim 1, wherein the snow catcher is welded closed.

8. The snowguard of claim 1, wherein the snow catcher is bonded to the first body.

9. The snowguard of claim 1, wherein the snow catcher is welded or glued to the first body.

10. The snowguard of claim 1, wherein the snowguard is made of steel.

11. The snowguard of claim 1, wherein the snowguard is made from a rigid material.

12. The snowguard of claim 1, wherein the shaft is disposed below the snow catcher.

13. The snowguard of claim 1, wherein the snow catcher is adjacent to the shaft.

14. The snowguard of claim 1, wherein the shaft is coupled to the snow catcher at the snow catchers outer surface.

15. A snow management system installed on a roof comprising roof shingles, the snow management system comprising:

a snowguard comprising:

a shaft having a first end and a second end, the shaft having a first body disposed between the first end and the second end, the shaft shaped and sized to be installed in a keyway defined between a pair of roofing shingles, wherein the shaft is retained in the keyway between the pair of roofing shingles, an attachment point formed at the first end of the shaft, the attachment point defining a first aperture, a support member formed at the second end of the shaft and extending away from the shaft at a first angle, the support member having a third end and a fourth end, the support member having a second body defined between the third end and the fourth end, and a snow catcher operatively formed at the fourth end of the support member and comprising an outer surface, the outer surface of the snow catcher bonded to the first body at a point between the first end and the second end;

a seal having a shaft portion and a base portion, the shaft portion installable through the first aperture of the attachment point;

a fastener installable through the shaft portion and the attachment point and configured to attach the snowguard to the roof; and a flashing defining a pair of flashing tabs on a downslope side of the flashing, the flashing tabs defining a fastener channel, the flashing installable between the fastener and the attachment point, the fastener configured to compress the flashing against the attachment point.

16. The management system of claim 15, wherein the snow catcher can be a shape including one of a loop, a rectangle, a multifaceted structure, a circle, an oval, and a triangle.

* * * * *